US008764284B2

(12) United States Patent
Briswalter et al.

(10) Patent No.: US 8,764,284 B2
(45) Date of Patent: Jul. 1, 2014

(54) PUSH BUTTON FOR TIMEPIECE INCORPORATING A VALVE

(71) Applicant: Omega SA, Biel/Bienne (CH)

(72) Inventors: Sebastien Briswalter, Pfetterhouse (FR); Eric Vuilleme, Bienne (CH); Gregory Kissling, Macolin (CH)

(73) Assignee: Omega SA, Biel/Bienne (CH)

( * ) Notice: Subject to any disclaimer, the term of this patent is extended or adjusted under 35 U.S.C. 154(b) by 0 days.

(21) Appl. No.: 13/921,593

(22) Filed: Jun. 19, 2013

(65) Prior Publication Data

US 2014/0010055 A1 Jan. 9, 2014

(30) Foreign Application Priority Data

Jul. 9, 2012 (EP) ..... 12175537

(51) Int. Cl.
*G04B 3/04* (2006.01)
*G04B 37/10* (2006.01)

(52) U.S. Cl.
CPC ..... *G04B 3/046* (2013.01); *G04B 37/106* (2013.01)
USPC ..... 368/308; 368/320

(58) Field of Classification Search
CPC ..... G04B 3/04; G04B 3/041; G04B 3/046; G04B 37/10; G04B 37/106
USPC ..... 368/288–290, 306, 308, 319–321
See application file for complete search history.

(56) References Cited

U.S. PATENT DOCUMENTS

| | | | | |
|---|---|---|---|---|
| 3,994,125 | A * | 11/1976 | Wenger | 368/290 |
| 5,257,247 | A * | 10/1993 | Miche et al. | 368/290 |
| 2007/0025190 | A1 * | 2/2007 | Cretin | 368/319 |

FOREIGN PATENT DOCUMENTS

| | | |
|---|---|---|
| CH | 699 558 A1 | 3/2010 |
| JP | 49-084072 U | 7/1974 |

OTHER PUBLICATIONS

European Search Report for Application No. EP 12 17 5537 dated Jan. 25, 2013.

* cited by examiner

*Primary Examiner* — Vit W Miska
(74) *Attorney, Agent, or Firm* — Sughrue Mion, PLLC

(57) ABSTRACT

Push button for a timepiece for correcting the time display associated with a decompression valve within a single control device. It essentially includes a first push button return spring (10) followed by a second spring (13) arranged to bend and act as a valve spring.

9 Claims, 2 Drawing Sheets

PUSH BUTTON FOR TIMEPIECE INCORPORATING A VALVE

This application claims priority from European Patent Application No. 12175537.5 filed Sep. 7, 2012, the entire disclosure of which is incorporated herein by reference.

FIELD OF THE INVENTION

The present invention relates to a push button for a timepiece including a cylindrical armature inside which there is a longitudinally-arranged through push button (respectively a corrector) formed of a head, having a bottom face abutting against a first shoulder made in the armature when manual pressure is exerted on the head, and a stem ending in a screw limiting the axial travel of the stem in the armature. A first return spring of the push button is wound about the stem.

BACKGROUND OF THE INVENTION

Push buttons conforming to the above description are well known in the state of the art. They are, for example, fitted to chronographs or wristwatches for correcting, for example, the date. They are called "push buttons" when they protrude from the middle part and correct a function when pressed with a finger. When the pressure ceases, the push buttons return to their initial position. They are usually called "correctors" when they are embedded in the middle part of the watch. In principle, each push button is linked to the correction of a single function; thus where there is a plurality of functions to be corrected, a plurality of push buttons must be fitted to the middle part of the timepiece, which then weakens the sealing of said timepiece.

The idea of the present invention is to give a conventional push button an additional function, to avoid further piercing the timepiece. The additional function may consist of a valve fitted to a diver's watch.

For the reasons set out above, CH Patent Application No 699 558 A1 has already proposed a screw-in winding crown associated either with a push button, or with a valve in a single control device. There is no description or suggestion of a combined push button-valve.

As is well described in the aforecited document, diver's watches often include both a winding crown and a valve to prevent the watch exploding when the diver returns to the surface. Indeed, as explained in said document, professional divers descend to great depths to carry out work and are then returned to the surface using a pressurised chamber which controls the decompression stops required for the diver's health. During these decompression stops, gases—essentially helium—penetrate the divers' watch case through the sealing gaskets which are essentially suited to preventing water or dust from entering inside the watch. When the pressure in the chamber drops during decompression stops, if there is no pressure balance device in the watch, excess pressure may build up inside the watch relative to the surrounding pressure, which may cause the watch to explode. In diver's watches, a valve is arranged separately from the other controls for the pressure balance. However, this valve suffers from the same drawbacks as those affecting push buttons or crowns with respect to sealing problems.

SUMMARY OF THE INVENTION

To avoid the aforecited drawback, the present invention proposes a push button conforming to the definition given in the first paragraph of this description, further characterized in that a second spring, placed after said first spring, is wound around the stem; one end of said second spring rests on said first retaining means and the other end rests on a second retaining means of said armature. The second spring is calibrated to a force matching the compensating pressure to bend and act as a valve if the pressure inside the timepiece is higher than the pressure prevailing outside said timepiece.

The features and advantages of the present invention will appear from the following description, given with reference to the annexed drawings, and providing, by way of explanatory, but non-limiting example, two advantageous embodiments of the invention. In the drawings:

DETAILED DESCRIPTION OF THE PREFERRED EMBODIMENTS

Figure 3:
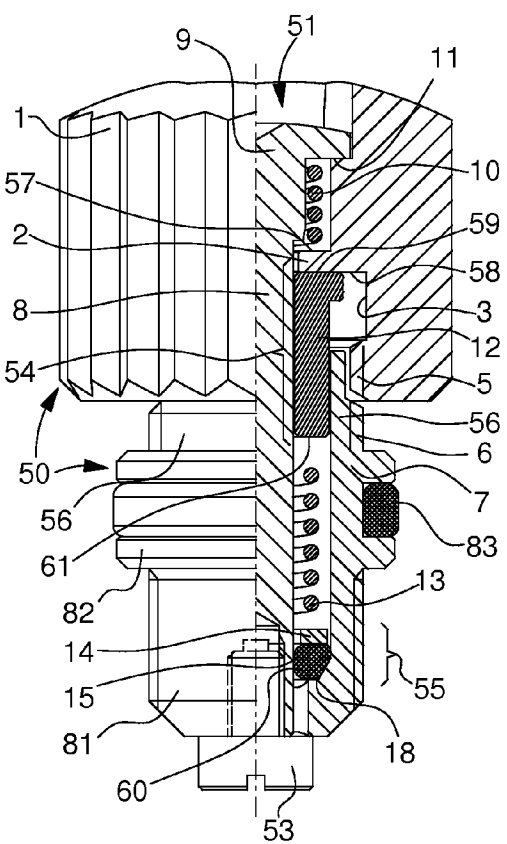
FIGS. 1 to 3 are plan and cross-sectional views of a first embodiment of the push button-valve according to the present invention.
Figure 2:
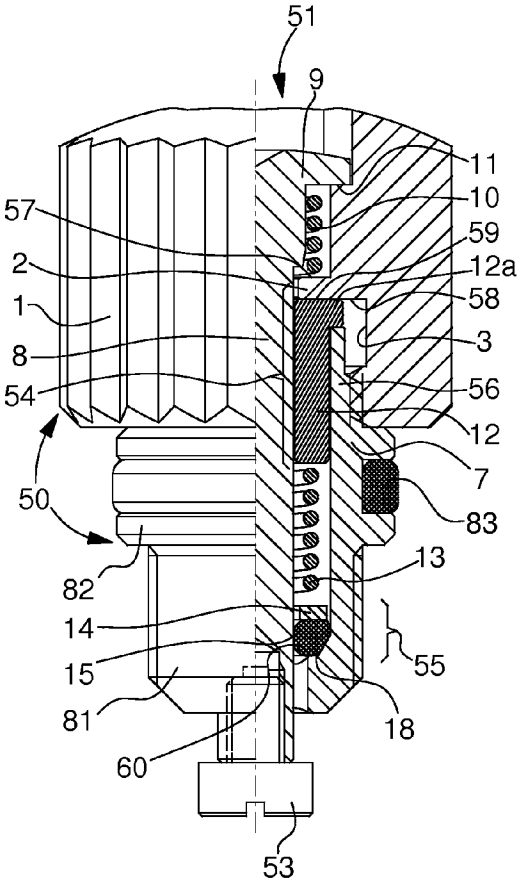
Figure 1:
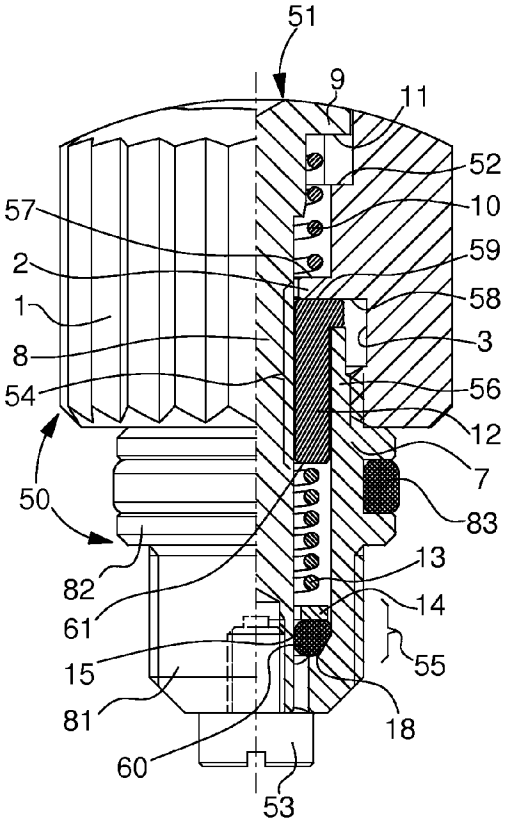

In the first embodiment shown in FIGS. 1 to 3, the push button includes a cylindrical armature 50 inside which there is a longitudinally-arranged through push button 51 formed of a head 9, having a bottom face 11 abutting against a first shoulder 52 made in armature 50 when manual pressure is exerted on head 9. Cylindrical armature 50 is in two parts; the first part is formed of a tube 7 fixed in the middle part of the timepiece. Here, tube 7 is screwed into the middle part of the timepiece via the bottom tube portion 81 and in the median tube portion has a bulge 82 provided with a groove housing an O-ring joint 83 sealing the tube at the level of the case. Tube 7 ends in a top tube portion 56 which protrudes from the middle part of the timepiece. This protruding portion 56 is provided with an external thread 6. A crown 1 forms the second part of armature 50. The inner circumference 3 of crown 1 is provided with an inner threaded portion 5 suitable for screwing onto external thread 6 of tube 7.

Following head 9, in the direction of the middle part of the timepiece, push button 51 has a stem 8, which ends in a retaining means limiting the axial travel of the stem in armature 50. In the example illustrated, the retaining means is formed by a screw 53, screwed into the end face of stem 8 in the axial extension of the stem so that the head of screw 53 is stopped against the end face of tube 7 disposed on the side of the middle part of the timepiece. The screw thus enables the push button to be assembled on armature 50.

A first push button return spring 10 is wound around push button stem 8. This spring 10 is disposed between the bottom face 11 of push button head 9 and first retaining means 54 partially derived from armature 50. In this first embodiment, first retaining means 54 comprises a second shoulder 2 arranged in crown 1. Second shoulder 2 has a top face 57, on which first spring 10 abuts, and a bottom face 58, on which there abuts the top portion 59 of a cylindrical spacer 12 secured to stem 8. The top end portion of cylindrical spacer 12 has a collar **12*a* whose function will be described below. The push button stem is moveable relative to spacer 12**.

After said first spring 10, a second spring 13 is wound around stem 8. One end of this second spring 13 is supported on said first retaining means 54 and the other end on a second retaining means 55, partially derived from armature 50.

This second spring 13 is arranged to bend and act as a valve spring if the pressure prevailing inside the timepiece is greater than the pressure prevailing outside said timepiece. Here, the second retaining means 55 comprises a third shoulder 18 arranged at the inner end of tube 7. This third shoulder has a top face 60 on which a first O-ring joint 15 is mounted, followed by a sealing washer or ring 14, and second spring 13 is disposed between said ring 14 and the bottom portion 61 of said spacer 12.

It will be noted that, in practice and in a non-limiting manner, the stiffness of first spring 10 is greater than that of second spring 13.

In this first embodiment and according to a first preferred variant, it is seen that cylindrical spacer 12 is made of deformable material so as to seal the push button. Preferably, cylindrical spacer 12 is made in a material having a shore hardness of between 50 and 100 and more preferably between 75 and 90. By way of non-limiting example, this spacer could typically be made of nitrile rubber (acrylonitrile-butadiene rubber NBR).

More particularly, FIG. 1 shows the push button valve whose crown 1 is screwed onto tube 7, with push button 5 in the rest position. In this situation the valve is closed, and second spring 13 is compressed between spacer 12 and ring 14.

FIG. 2 illustrates the same screwed-in situation, where push button 51 is activated, with screw 53 of stem P activating a correction system of the timepiece, for example, to correct the date displayed on the dial.

FIGS. 1 and 2 show that the push button is sealed, on the one hand by deformable spacer 12, whose collar 12*a* is clamped between the bottom face 58 of shoulder 2 and the end of the protruding portion 56 of tube 7 and on the other hand, at the tube-case connection by O-ring joint 83.

FIG. 3 shows the push button-valve whose crown 1 is unscrewed from tube 7. In this situation, second spring 13 is relaxed and the joint formed by collar 12*a* of the spacer is no longer active. Thus, joint 15 is capable of rising up against the return force of second spring 13 when the pressure inside the watch case is higher than that prevailing outside, which allows the valve to function. The compressed helium in the timepiece can escape through the space between cylindrical spacer 12 and the push button stem, or respectively the inner wall of tube 7, then through the threaded portion 5 of crown 1.

As seen in FIG. 3, it is to be noted that water resistance is entirely guaranteed by joint 15 and that the valve is thus also arranged to be unscrewed underwater.

Thus, when the crown is screwed onto the threaded portion of tube 7 as shown in FIGS. 1 and 2, the valve is inoperative and completely watertight. When the timepiece is employed in a liquid medium and at very great depths, the diver screws in crown 1, which makes the push button valve completely watertight not simply by crushing collar 12*a* against the end of protruding portion 56 of tube 7, but also by the additional effect of joint 15, since second spring 13 develops an additional force on joint 15 when the crown is screwed in.

Figure 4:
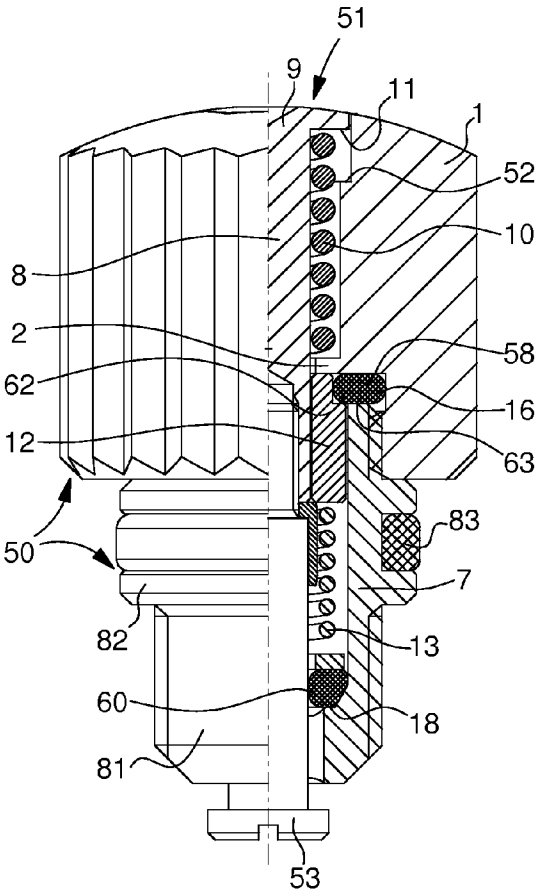
FIG. 4 is an alternative embodiment of the push button-valve shown in FIGS. 1 and 3.

FIG. 4 shows a second variant of the first embodiment in which a second O-ring joint 16 has been added to a non-deformable spacer 12, arranged between bottom face 58 of second shoulder 2 and a recess 62 made in spacer 12. It is seen that second O-ring joint 16 abuts on end 63 of tube 7 when the crown is screwed onto the tube. In this variant, O-ring joint 16 plays the part of collar 12*a* illustrated in FIGS. 1 to 3.

Figure 6:
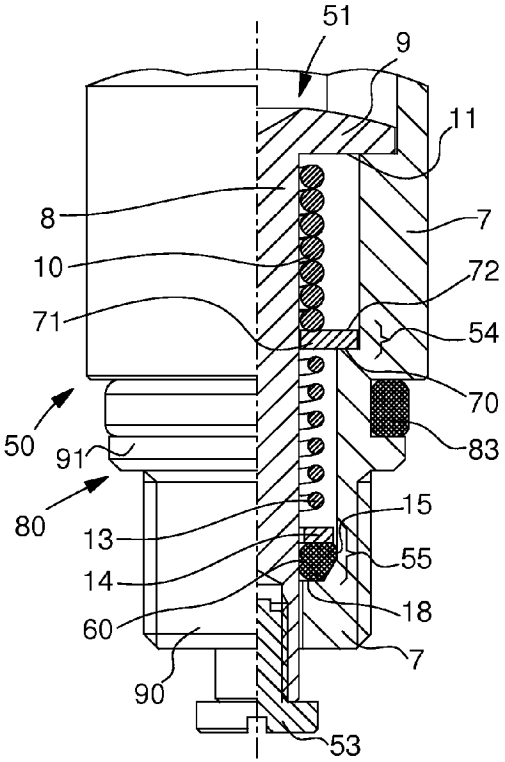
FIGS. 5 and 6 are plan and cross-sectional views of a second embodiment of the push button-valve according to the present invention.
Figure 5:
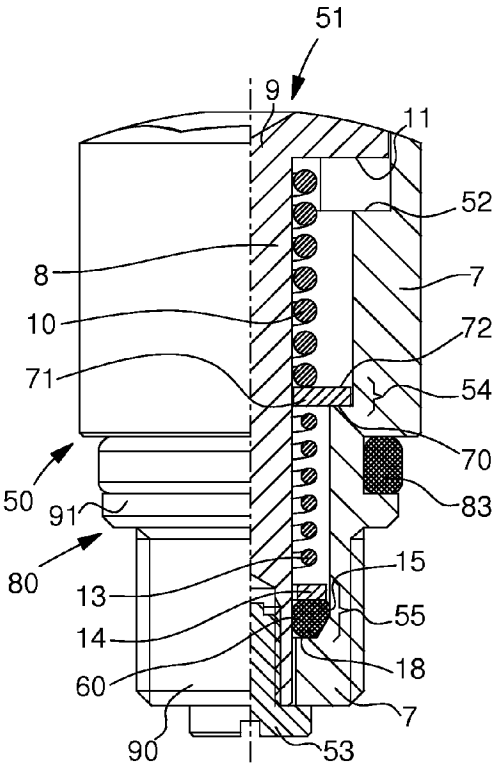

It will be noted in the second embodiment shown in FIGS. 5 and 6 that the push button includes a cylindrical armature 50 inside which there is a longitudinally-arranged through push button 51 formed of a head 9, which has a bottom face 11 abutting against a first shoulder 52 made in armature 50 when manual pressure is exerted on head 9. In this embodiment, armature 50 includes a single tube 7. A first portion 90 of the bottom part 80 of the tube is screwed into the middle part of the timepiece and a second median portion 91 is provided with an O-ring joint 83 sealing the tube relative to said middle part. After head 9, push button 51 includes a stem 8, which ends in a screw 53 with a head for assembling the push button and limiting the axial travel of the stem in armature 50. The head of screw 53 abuts against the end face of tube 7 disposed on the middle part side of the timepiece.

A first return spring 10 is wound around stem 8. This spring is disposed between the bottom face 11 of head 9 and a first retaining means 54 partially derived from armature 50. This retaining means includes a second shoulder 70 arranged in the inner wall of tube 7 and on which a washer 71 rests; the top face 72 of this washer acts as a support for first spring 10.

After said first spring 10, there is a second spring 13 wound around stem 8, one end of which rests on said first retaining means 54 and the other end of which rests on a second retaining means 55 partially derived from armature 50. The second spring is arranged to bend and act as a valve if the pressure prevailing inside the timepiece is higher than the pressure prevailing outside said timepiece. Here, the second retaining means 55 is the same as that cited in relation to the first embodiment, namely a third shoulder 18 arranged at the inner end of tube 7. The third shoulder has a top face 60 on which a first O-ring joint 15 is mounted, followed by a ring 14; and the second spring 13 is disposed between said ring 14 and the bottom portion of said washer 71.

More particularly, FIGS. 5 and 6 show a push button-valve, whose push button is in the rest state in FIG. 5 and in the activated state in FIG. 6. In both cases, the valve is potentially active whatever the position of the push button and operates in the same manner as described with reference to the push button-valve illustrated in FIGS. 1 to 4. Thus, when the pressure inside the watch case is higher than the external pressure, O-ring joint 15 can rise up against the return force of second spring 13, which allows the pressurised air in the timepiece to escape through the space between the push button stem and the inner wall of tube 7. FIGS. 5 and 6 thus show an automatic valve, whereas FIGS. 1 to 4 show a manual valve.

What is claimed is:

1. A push button for a timepiece comprising a cylindrical armature inside which there is a longitudinally-arranged, through push button formed of a head, having an inner face abutting against a first shoulder made in the armature when manual pressure is exerted on the head, and of a stem which ends in a retaining means limiting the axial travel of said stem in the armature; a first push button return spring is wound around the stem, said spring is arranged between the bottom face of the head and a first retaining means partially derived from said armature, said push button being wherein it includes a second spring wound around the stem; one of the ends of said second spring rests on said first retaining means and the other end thereof rests on a second retaining means partially derived from said armature, the second spring being arranged to bend and act as a valve if the pressure prevailing inside the timepiece is higher than the pressure prevailing outside said timepiece.

2. The push button according to claim 1, wherein said second spring is placed after said first spring towards the end of the stem.

3. The push button according to claim 1, wherein said retaining means includes a screw screwed into the axial extension of the stem.

4. The push button according to claim 1, wherein the cylindrical armature includes a tube fixed in the middle part of the timepiece, said tube having a protruding portion provided with an external thread, and a crown provided with an inner threaded portion on the inner circumference thereof suitable for screwing onto the external thread of the tube, wherein the first retaining means includes a second shoulder derived from the crown, said second shoulder having a top face on which the first spring abuts and a bottom face on which there abuts the top portion of a cylindrical spacer mounted on the stem and wherein the second retaining means includes a third shoulder derived from the tube, said third shoulder having a top face on which a first O-ring joint is mounted, followed by a ring, the second spring being disposed between said ring and the bottom portion and said spacer.

5. The push button according to claim 4, wherein said cylindrical spacer is made of deformable material.

6. The push button according to claim 5, wherein the deformable material of said cylindrical spacer has a shore hardness of between 50 and 100 and preferably between 75 and 90.

7. The push button according to claim 4, wherein a second O-ring joint is disposed between the bottom face of the second shoulder and a recess made in the spacer, said second joint resting on the top end of the tube when the crown is screwed onto said tube.

8. The push button according to claim 1, wherein the cylindrical armature includes a single tube, a bottom portion of which is fixed in the middle part of the timepiece, wherein the first retaining means includes a second shoulder derived from the tube and on which a washer rests, the top face of said washer acting as a support for the first spring and wherein the second retaining means includes a third shoulder derived from the tube, said third shoulder having a top face on which a first O-ring joint is mounted, followed by a ring, the second spring being disposed between said ring and the bottom portion of said washer.

9. The push button according to claim 1, wherein the stiffness of the first spring is greater than that of the second spring.

* * * * *